US007054816B2

(12) United States Patent
Aarts et al.

(10) Patent No.: US 7,054,816 B2
(45) Date of Patent: May 30, 2006

(54) AUDIO SIGNAL PROCESSING DEVICE

(75) Inventors: Ronaldus Maria Aarts, Eindhoven (NL); Robertus Theodorus Johannes Toonen Dekkers, Waalre (NL); Gerardus Cornelis Petrus Lokhoff, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 991 days.

(21) Appl. No.: 09/741,917

(22) Filed: Dec. 20, 2000

(65) Prior Publication Data

US 2001/0037194 A1 Nov. 1, 2001

(30) Foreign Application Priority Data

Dec. 24, 1999 (EP) ..... 99204543

(51) Int. Cl.
*G10L /21* (2006.01)
*H04R 5/00* (2006.01)

(52) U.S. Cl. ..... 704/270; 381/1

(58) Field of Classification Search ..... 381/1, 381/17, 18

See application file for complete search history.

(56) References Cited

U.S. PATENT DOCUMENTS 5,742,687 A 4/1998 Aarts ..... 381/1
6,198,826 B1 * 3/2001 Cowieson et al. ..... 381/18
2002/0097880 A1 * 7/2002 Kirkeby ..... 381/1

FOREIGN PATENT DOCUMENTS

JP 07-056497 * 3/1995

OTHER PUBLICATIONS

Patent Abstracts of Japan, vol. 1997, No. 09, Oct. 30, 1997, JP 09114479 A.
Patent Abstracts of Japan, vol. 1997, No. 07, Jul. 31, 1997, JP 09084198 A.
Patent Abstracts of Japan, vol. 016, No. 158, Apr. 17, 1992, JP 04010743 A.
Patent Abstracts of Japan, vol. 1995, No. 11, Dec. 26, 1995, JP 07222298 A.

* cited by examiner

*Primary Examiner*—Richemond Dorvil
*Assistant Examiner*—V. P. Harper
(74) *Attorney, Agent, or Firm*—Edward W. Goodman

(57) ABSTRACT

An audio signal processing device includes a signal supply for supplying speech and music signals via one or more input channels. The device further includes a signal separator for separating the speech and music signals. A first converter converts the music signals into desired virtual widened signals from one or more input channels. A signal combiner used to combine the speech signals with the widened music signals.

5 Claims, 1 Drawing Sheet

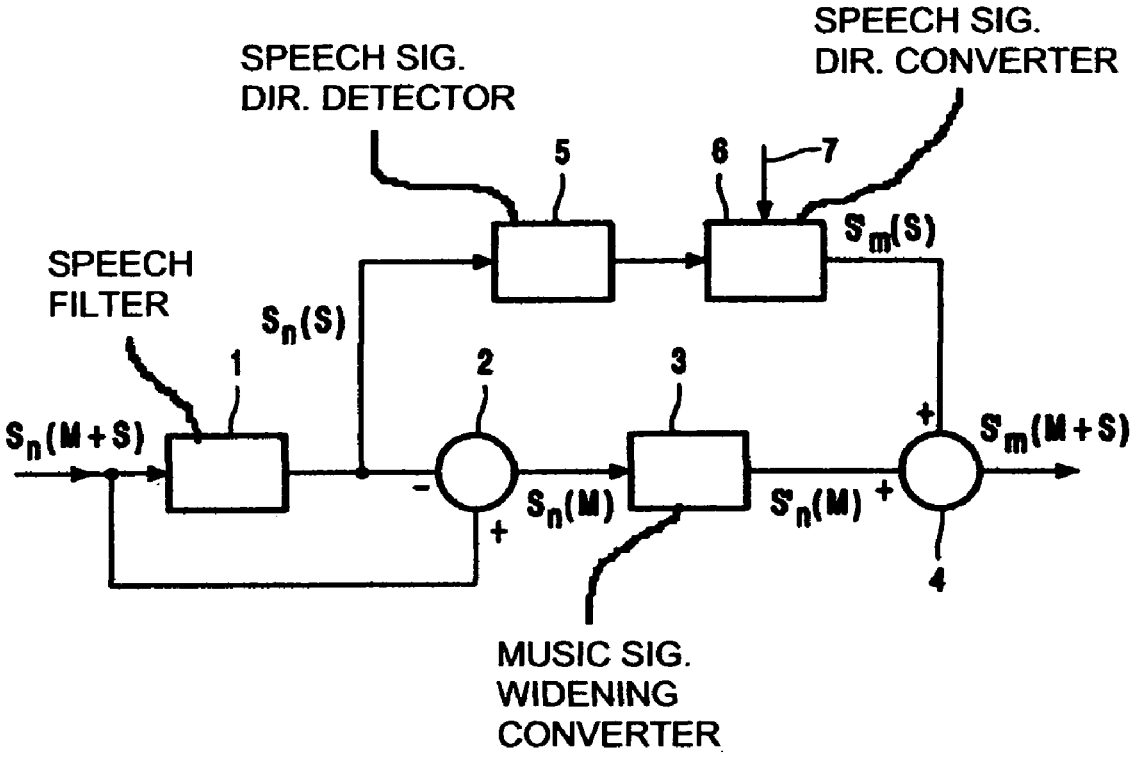
SPEECH SIG.
DIR. DETECTOR
SPEECH SIG.
DIR. CONVERTER
5
6
7
SPEECH
FILTER
$S_n(S)$
$S'_m(S)$
1
2
3
$S_n(M+S)$
$S'_m(M+S)$
$S_n(M)$
$S'_n(M)$
4
MUSIC SIG.
WIDENING
CONVERTER

AUDIO SIGNAL PROCESSING DEVICE

BACKGROUND OF THE INVENTION

1. Field of the Invention

The invention relates to an audio signal processing device for speech and music signals.

2. Description of the Related Art

Although the speech and music signals come from a certain direction defined by an arrangement of loudspeakers, there is, nevertheless, a demand that speech and music signals should seem to come from different directions, as perceived by listeners.

SUMMARY OF THE INVENTION

To achieve this object, the audio signal processing device, according to the invention, is provided with signal supply means for supplying speech and music signals over one or several (n) different input channels, separation means for substantially separating the speech and music signals, first converter means for converting the music signals in accordance with a desired virtual spatial widening from which the music signals can be heard through one or several (m) different output channels, and combination means for combining the speech signals with the converted music signals.

It is true for the case in which n=2 and m=2, i.e., for conventional stereo sound reproduction, for example, with the use of headphones, that music can be heard with a virtual spatial spread through the use of an audio signal processing device according to the invention, and speech can be equally distributed over the two channels (left and right) as a mono signal, or can be heard through one of the two channels (left or right). The music heard in a wider spatial virtual spread is referred to hereinafter as "widened" music for short. The device according to the invention renders it possible, accordingly, to widen music but not speech, and can be effective both for speech and music signals separately and for the simultaneous reproduction of speech and music.

Since it may be desirable, in certain circumstances, to have the speech appear from any desired direction, it is furthermore possible, according to the invention, that signal direction detection means is present for ascertaining the direction from which the speech signals originate, and second converter means for converting the speech signals in accordance with a desired virtual change in the direction from which the speech signals can be heard, the converted speech signals and the converted music signals being joined together in the combination means.

This measure renders it possible, for example, that speech is still being heard through headphones from the direction of a speaker, whether the latter is stationary or is walking to and fro, or even if several speakers are present who address an auditorium consecutively from different spatial angles. The measures according to the invention may also be important for video-conferencing, where the speech can also be made to originate from the direction of the speaker on a displayed video picture and not from the direction from which image and sound were recorded. It may be especially unpleasant and adversely affect the ease of understanding of speech when the perceived directions of image and sound do not coincide.

The second converter means mentioned above may be provided with one or several additional input channels through which speech and position signals can be supplied from a microphone having position recording means.

Speech signals from a further speaker can be inserted in this manner, and be reproduced as though coming from the direction of this speaker.

The invention further relates to an audio reproduction system provided with an audio signal processing device as described above, and with sound reproduction means for the separate output channels for rendering amplified speech and music signals audible.

The invention also relates to an audiovisual reproduction system provided with an audio signal processing device as described above and to a unit in which a picture screen and sound reproduction means are incorporated.

BRIEF DESCRIPTION OF THE DRAWING

The invention will now be explained in more detail below with reference to the accompanying drawing, in which:

The sole FIGURE is a block diagram representing the functions of the audio signal processing device according to the invention.

DESCRIPTION OF THE PREFERRED EMBODIMENT

The Figure shows a speech filter 1 in which the n input signals $S_n(M+S)$ are filtered, only the speech signals $S_n(S)$ being present at the output. The music signals $S_n(M)$ are obtained by subtracting the speech signals from the input signals in differentiating means 2. In practice, the speech filter and the differentiating means together form separating means for substantially separating the speech signals from the music signals. Such separating means are known per se from Karaoke techniques and are based on the effect, for example, that speech is present in a certain frequency band or is distributed over the input channels with a fixed weighting or a weighting which changes with the movement of speakers.

The music signals $S_n(M)$ are converted to so-called widened music signals $S_m'(M)$ in (first) converter means 3 in accordance with a desired virtual spatial widening from which the music signals can be heard through the individual channels. The number of input channels n obviously need not be equal to the number of output channels m. Such music widening techniques are also known per se, for example, from U.S. Pat. No. 5,742,687. Finally, the speech signals $S_n(S)$ can be combined again with the widened music signals by combination means 4. The music signals are widened in this manner, whereas the speech signals are perceived as coming from the original direction. If two channels are present, and music and speech are amplified and reproduced through two loudspeakers L (left) and R (right), it can be achieved with this system that the music is perceived as coming from two virtual loudspeakers, while the speech is perceived as coming from both or one of the two loudspeakers.

Since it may be desirable that also the speech signals can be perceived as coming from an adjustable direction, the audio signal processing device shown in the Figure is, in addition, provided with signal direction detection means 5 and second converter means 6. The direction from which the speech signals originate is ascertained in the signal direction detection means, for example, through the use of known PCA (principal component analysis) techniques. The speech signals are converted to speech signals $S_m'(S)$ in the second converter means 6 in accordance with a desired virtual change in the direction from which the speech signals can be heard. The signals are subjected to a matrix multiplication in a known manner, the matrix coefficients for the desired virtual channels being determined by calibration, so as to achieve that the signals transmitted through real channels are perceived as coming through virtual channels. If two channels are present, and speech is transmitted in amplified form through two loudspeakers L (left) and R (right), for example, both equally strongly, such a matrix multiplication achieves that a stronger signal is perceived as coming from the one loudspeaker than from the other loudspeaker, which means that the speech is perceived as coming from a different (virtual) direction, defined by the matrix coefficients, as compared with the original direction defined by the loudspeakers.

The second converter means 6 mentioned above may, in addition, be provided with one or several additional input channels 7 through which speech and position signals can be supplied from a microphone which has position detection means. Speech signals from a further speaker can thus be inserted and reproduced as if they were coming from the direction of this speaker.

The converted speech and music signals may be joined together again by the combination means 4 into signals $S_m'$(M+S). The music signals are thus widened, while the speech signals are perceived as coming from a direction which may be adjusted. If two channels are present, and music and speech are transmitted in amplified form through two loudspeakers L (left) and R (right), it is possible, by means of this system, to achieve that the music is perceived as coming from two virtual loudspeakers, whereas the speech is perceived as coming from a certain, selected direction.

It will be obvious that the invention is not limited to applications in which only two input and output channels are present. Any number of input and output channels desired, in practice, is possible. Thus, a monosignal $S_1$(M+S) may be supplied to the audio processing device through an input channel, and a specific speech signal through the additional input channel, while the output signal is reproduced in mono or in stereo, for example, in the case of video-conferencing. Such a situation is comparable to that in which signals $S_2$(M+S) are supplied to the audio signal processing device through two separate input channels.

What is claimed is:

1. An audio signal processing device comprising:

input means for receiving combined speech and music signals on n input channels, n being an integer;

separating means for substantially separating the speech signals from the music signals;

signal direction detection means for ascertaining a direction from which the speech signals originate;

converter means for converting the speech signals in accordance with a desired virtual change in the direction from which the speech signals can be heard, said converter means forming modified speech signals; and combination means for combining the modified speech signals and the music signals, and for outputting the combination modified speech and music signals on m output channels, m being an integer.

2. The audio signal processing device as claimed in claim 1, characterized in that the converter means comprises one or several additional input channels for receiving speech and position signals from a microphone having position recording means.

3. An audio reproduction system comprising:

an audio signal processing device as claimed in claim 1; and sound reproduction means for reproducing amplified speech and music signals.

4. An audiovisual reproduction system comprising:

an audio signal processing device as claimed in claim 1; and a unit including a picture screen and sound reproduction means.

5. The audio signal processing device as claimed in claim 1, wherein said audio signal processing device further comprises:

further converter means coupled to said separation means for converting the music signals, in accordance with a desired virtual spatial widening, into widened music signals, said widened music signals being combined with said modified speech signals in said combination means.

* * * * *